US009343016B2

(12) United States Patent
Matsumoto

(10) Patent No.: US 9,343,016 B2
(45) Date of Patent: May 17, 2016

(54) DISPLAY DEVICE

(71) Applicant: NICHIA CORPORATION, Anan-shi (JP)

(72) Inventor: Makoto Matsumoto, Itano-gun (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 14/490,632

(22) Filed: Sep. 18, 2014

(65) Prior Publication Data

US 2015/0084532 A1 Mar. 26, 2015

(30) Foreign Application Priority Data

Sep. 20, 2013 (JP) ..... 2013-196253

(51) Int. Cl.
*G09G 3/32* (2006.01)

(52) U.S. Cl.
CPC ..... *G09G 3/3275* (2013.01); *G09G 3/3216* (2013.01); *G09G 2320/0233* (2013.01); *G09G 2330/021* (2013.01); *G09G 2330/025* (2013.01); *G09G 2330/04* (2013.01)

(58) Field of Classification Search
CPC ..... G09G 2300/043; G09G 2300/025
See application file for complete search history.

(56) References Cited

U.S. PATENT DOCUMENTS 4,626,072 A * 12/1986 Clerc ..... G02F 1/134336 345/204
5,619,221 A * 4/1997 Hirai ..... G09G 3/3622 345/100
5,760,757 A * 6/1998 Tanaka ..... G09G 3/3622 345/93
6,985,124 B1 * 1/2006 Nogawa ..... G09G 3/32 345/55
8,044,898 B2 * 10/2011 Sakai ..... G09G 3/14 345/34
2002/0122016 A1 * 9/2002 Iwasa ..... G09G 3/296 345/60
2003/0227278 A1 * 12/2003 Sakuragi ..... G09G 3/3216 320/135

FOREIGN PATENT DOCUMENTS

JP 2001-109433 4/2001

* cited by examiner

*Primary Examiner* — Douglas W Owens
*Assistant Examiner* — Dedei K Hammond
(74) *Attorney, Agent, or Firm* — Mori & Ward, LLP

(57) ABSTRACT

A display device includes a plurality of common lines, a plurality of driving lines, a plurality of light emitting elements, a source driver, a sink driver, discharge devices, discharge limiting devices, and rectifying devices. The discharge devices are connected to the common lines and configured to lower voltage at the connected common lines. The discharge limiting devices are connected to the common lines and to the discharge devices, and apply a limitation so that the voltage at the connected common lines is not lowered below a prescribed value by the discharge devices. The rectifying devices are connected between the discharge devices and the discharge limiting devices, and the common lines, and pass a current from the common lines toward the discharge devices and the discharge limiting devices but do not pass a current from the discharge devices and the discharge limiting devices toward the common lines.

16 Claims, 8 Drawing Sheets

DISPLAY DEVICE

CROSS-REFERENCE TO RELATED APPLICATIONS

The present application claims priority under 35 U. S. C. §119 to Japanese Patent Application No. 2013-196253, filed Sep. 20, 2013. The contents of this application are incorporated herein by reference in their entirety.

BACKGROUND OF THE INVENTION

1. Field of the Invention

The present disclosure relates to a display device.

2. Discussion of the Background

Conventionally, proposed is a dot matrix display device in which a plurality of scanning electrodes (common lines) and a plurality of signal electrodes (driving lines) are provided in a matrix-like crisscross arrangement and a display element is driven by a voltage between a scanning electrode (common line) and a signal electrode (driving line) at each intersection of the matrix, wherein a rectifier element is electrically connected in a prescribed polarity orientation between a scanning electrode (common line) and a reference voltage terminal that provides a prescribed reference potential, and a charge on the scanning electrode (common line) is discharged toward the reference voltage terminal via the rectifier element (refer to Japanese Patent Application Laid-open No. 2001-109433).

SUMMARY OF THE INVENTION

According to one aspect of the present invention, a display device includes a plurality of common lines, a plurality of driving lines, a plurality of light emitting elements, a source driver, a sink driver, discharge devices, discharge limiting devices, and rectifying devices. The plurality of light emitting elements are connected to the plurality of common lines and the plurality of driving lines. The source driver is configured to apply voltage by time division to the plurality of common lines. The sink driver is configured to draw a current from one or more driving lines among the plurality of driving lines to turn on one or more light emitting elements. The discharge devices are connected to the common lines and configured to lower voltage at the connected common lines. The discharge limiting devices are connected to the common lines and to the discharge devices, and apply a limitation so that the voltage at the connected common lines is not lowered below a prescribed value by the discharge devices. The rectifying devices are connected between the discharge devices and the discharge limiting devices, and the common lines, and pass a current from the common lines toward the discharge devices and the discharge limiting devices but do not pass a current from the discharge devices and the discharge limiting devices toward the common lines.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1A:
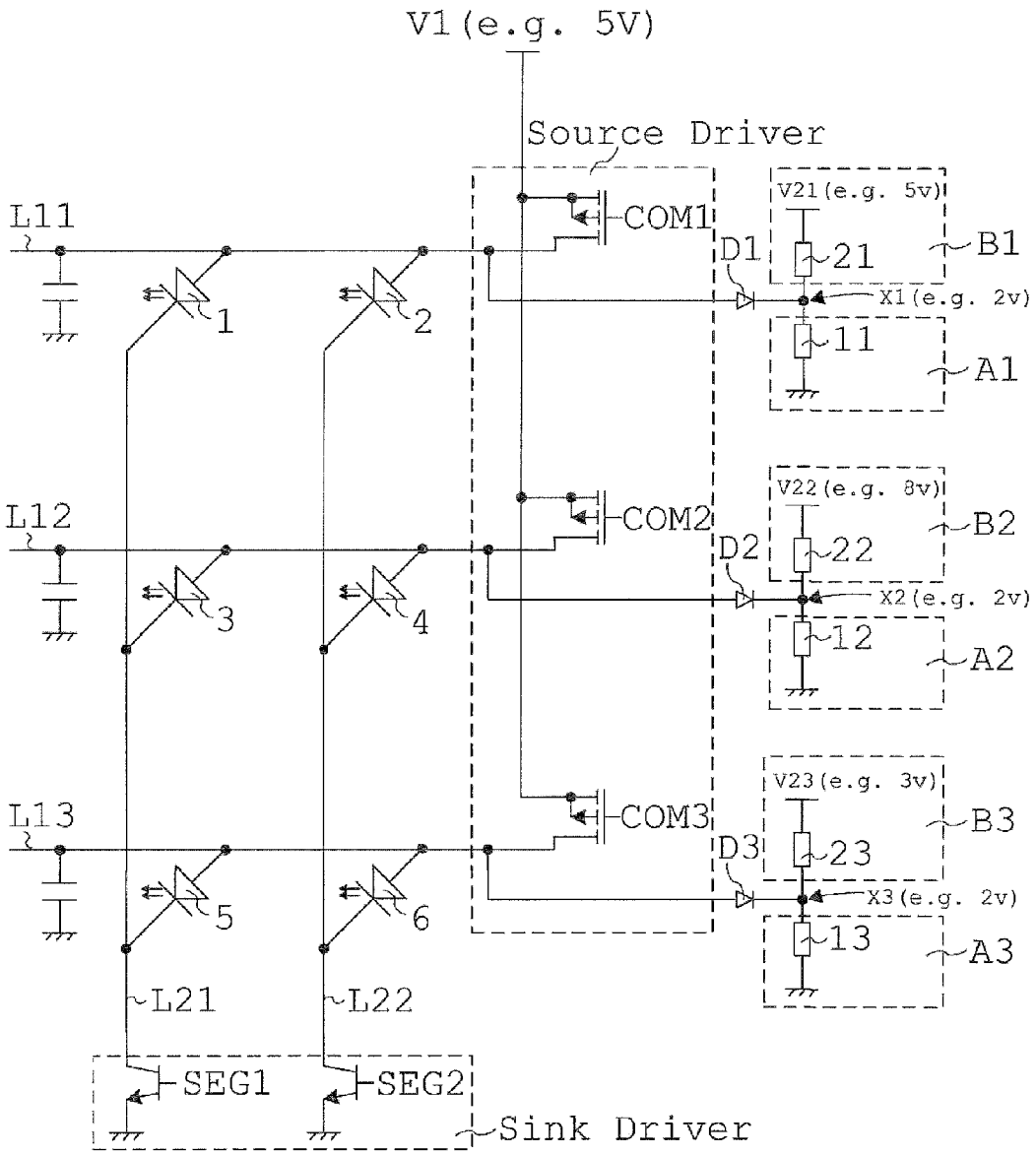
FIGS. 1A and 1B shows a circuit diagram (FIG. 1A) and a timing chart (FIG. 1B) of a display device according to a first embodiment.

The embodiments will now be described with reference to the accompanying drawings, wherein like reference numerals designate corresponding or identical elements throughout the various drawings.

[Display Device According to First Embodiment]

Figure 1B:
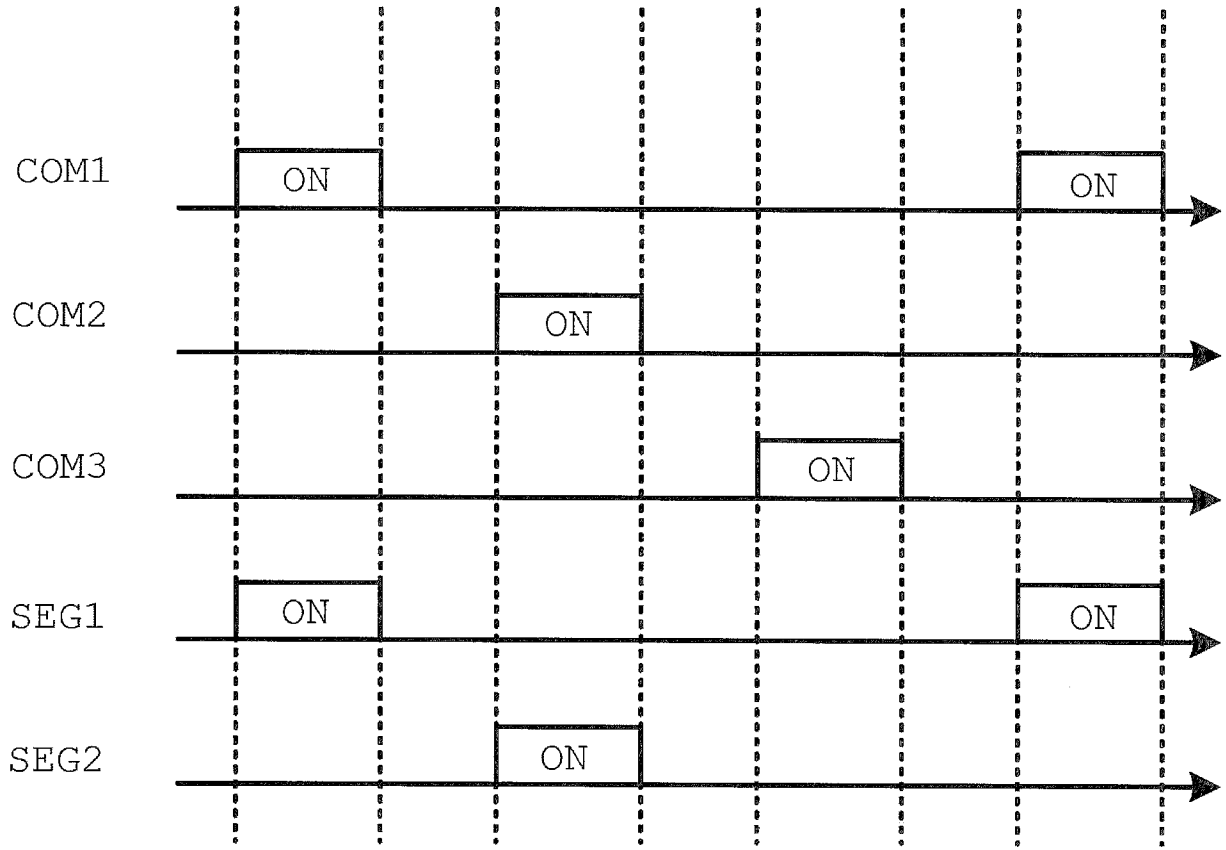

FIG. 1 shows a circuit diagram (FIG. 1A) and a timing chart (FIG. 1B) of a display device according to a first embodiment.

As shown in FIG. 1A, a display device according to the first embodiment is a display device including a plurality of common lines L11 to L13, a plurality of driving lines L21 and L22, a plurality of light emitting elements 1 to 6 connected to the plurality of common lines L11 to L13 and the plurality of driving lines L21 and L22, a source driver that applies voltage by time division to the plurality of common lines L11 to L13, and a sink driver that draws a current from one or more driving lines among the plurality of driving lines L21 and L22 to turn on one or more light emitting elements which is or are connected to the one or more driving lines, discharge devices A1 to A3 which are connected to the common lines L11 to L13 and which lower voltage at a connected common line, discharge limiting devices B1 to B3 which are connected to the common lines L11 to L13 and to the discharge devices A1 to A3 and which apply a limitation so that voltage at the connected common line is not lowered below a prescribed value by the discharge devices A1 to A3, and rectifying devices D1 to D3 which are connected between the discharge devices A1 to A3 and the discharge limiting devices B1 to B3, and the common lines L11 to L13, and which pass a current from the common lines L11 to L13 toward the discharge devices A1 to A3 and the discharge limiting devices B1 to B3 but do not pass a current from the discharge devices A1 to A3 and the discharge limiting devices B1 to B3 toward the common lines L11 to L13.

Hereinafter, a step-by-step description will be provided.

(Plurality of Common Lines, Plurality of Driving Lines)

For example, copper foil is used for the plurality of common lines L11 to L13 and the plurality of driving lines L21 and L22. For example, a part of wiring of a printed wiring board corresponds to the common lines L11 to L13 and the driving lines L21 and L22.

(Plurality of Light Emitting Elements)

For example, light emitting diodes shown in FIG. 1 are used as the plurality of light emitting elements 1 to 6. The plurality of light emitting elements 1 to 6 are connected to the plurality of common lines L11 to L13 and the plurality of driving lines L21 and L22.

(Source Driver)

The source driver includes, for example, semiconductor switches COM1 to COM3. As the semiconductor switches COM1 to COM3 included in the source driver, for example, P channel field effect transistors (FETs) shown in FIG. 1 or PNP transistors can be used. The source driver applies voltage by time division to the plurality of common lines L11 to L13 by, for example, opening and closing the semiconductor switches COM1 to COM3 by time division and connecting the plurality of common lines L11 to L13 to a voltage supplying unit V1 by time division. Moreover, an example where voltage supplied by the voltage supplying unit V1 is set to 5 V is shown in FIG. 1 in order to facilitate understanding by using a specific numerical value, but the voltage supplied by the voltage supplying unit V1 is not limited to 5 V.

(Sink Driver)

The sink driver includes, for example, semiconductor switches SEG1 and SEG2. As the semiconductor switches SEG1 and SEG2 included in the sink driver, for example, NPN transistors shown in FIG. 1 or N channel FETs can be used. The sink driver draws a current from one or more driving lines among the plurality of driving lines L21 and L22 to turn on one or more light emitting elements which is or are connected to the one or more driving lines.

(Discharge Devices)

The discharge devices A1 to A3 are connected to the common lines L11 to L13 and lower the voltage at the connected common lines L11 to L13. In the first embodiment, the discharge devices A1 to A3 are respectively connected to the plurality of common lines L11 to L13.

The discharge devices A1 to A3 have wirings in which one end is connected to a side of the common lines L11 to L13 and another end is connected to a side of ground. The discharge devices A1 to A3, for example, may also include load elements 11 to 13 such as those shown in FIG. 1A. When the discharge devices A1 to A3 include load elements 11 to 13, an excessive current is prevented from flowing through the wirings of the discharge devices A1 to A3.

(Discharge Limiting Devices)

The discharge limiting devices B1 to B3 are connected to the common lines L11 to L13 and to the discharge devices A1 to A3 and apply a limitation so that voltage at the connected common lines L11 to L13 is not lowered below a prescribed value by the discharge devices A1 to A3. In the first embodiment, the discharge limiting devices B1 to B3 are respectively connected to the plurality of common lines L11 to L13.

The discharge limiting devices B1 to B3 have wirings in which one end is connected to a side of the common lines L11 to L13 and another end is connected to a side of voltage supplying units V21 to V23 or the like. The discharge limiting devices B1 to B3, for example, may also include load elements 21 to 23 such as those shown in FIG. 1A. When the discharge limiting devices B1 to B3 include load elements 21 to 23, an excessive current is prevented from flowing through the wirings of the discharge devices A1 to A3 and the like. Moreover, an example where voltage supplied by the voltage supplying units V21 to V23 connected to the other end of the discharge limiting devices B1 to B3 is respectively set to 5 V, 8 V, and 3 V is shown in FIG. 1 in order to facilitate understanding by using specific numerical values, but the voltage supplied by the voltage supplying units V21 to V23 is not limited to these value and may be the same (example: V21 to V23 may all be 5 V).

(Rectifying Devices)

The rectifying devices D1 to D3 are connected between the discharge devices A1 to A3 and the discharge limiting devices B1 to B3, and the common lines L11 to L13, and pass a current from the common lines L11 to L13 toward the discharge devices A1 to A3 and the discharge limiting devices B1 to B3 but do not pass a current from the discharge devices A1 to A3 and the discharge limiting devices B1 to B3 toward the common lines L11 to L13 (however, a minute leakage current or the like of a magnitude that does not affect operations of the circuits is allowed).

Rectifier elements such as rectifier diodes can be used as the rectifying devices D1 to D3.

(Operations)

As shown in FIG. 1B, when scanning by the source driver starts, voltage is applied to the plurality of common lines L11 to L13 by time division. Specifically, the semiconductor switches COM1 to COM3 repetitively open and close by a prescribe time interval in a sequence of the semiconductor switch COM1, the semiconductor switch COM2, the semiconductor switch COM3, the semiconductor switch COM1, and so on and voltage is sequentially applied to the plurality of common lines L11 to L13.

The sink driver draw a current from one or more driving lines among the plurality of driving lines L21 and L22 to turn on one or more light emitting elements which is or are connected to the one or more driving lines. In this case, assuming that the light emitting elements 1 and 4 are light emitting elements to be turned on, the semiconductor switch SEG1 closes and a current is drawn from the driving line L21 when voltage is being applied to the common line L11, and the semiconductor switch SEG2 closes and a current is drawn from the driving line L22 when voltage is being applied to the common line L12. Accordingly, the light emitting elements 1 and 4 are lighted.

When the common lines L11 to L13 are inactive (when voltage is not being applied by the source driver), parasitic capacitances thereof are respectively discharged via the rectifying devices D1 to D3 and the discharge devices A1 to A3. However, the discharges are limited by the discharge limiting devices B1 to B3 so that voltage at the respective common lines L11 to L13 is not lowered below a prescribed value. More specifically, in the first embodiment, voltage at points denoted by X1 to X3 in FIG. 1A is set as a prescribed value, and a parasitic capacitance of the respective common lines L11 to L13 is discharged by the discharge limiting devices B1 to B3 via the rectifying devices D1 to D3 and the discharge devices A1 to A3 only when the voltage at the respective common lines L11 to L13 respectively exceeds the voltage at the points denoted by X1 to X3.

The voltage at the points denoted by X1 to X3 is determined by a relationship between voltage supplied by the voltage supplying units V21 to V23 of the discharge limiting devices B1 to B3 and the load elements 21 to 23 of the discharge limiting devices B1 to B3 and the load elements 11 to 13 of the discharge devices A1 to A3, and is independent of a voltage drop of the rectifying devices D1 to D3. Therefore, the display device according to the first embodiment is capable of making voltage (voltage due to a parasitic capacitance) of inactive common lines uniform or approximately uniform even when there is variation in voltage drop of the rectifying devices D1 to D3. Moreover, in the first embodiment, a case has been described in which voltage supplied by the voltage supplying units V21 to V23 is respectively 5 V, 8 V, and 3 V, the load elements 21 to 23 of the discharge limiting devices B1 to B3 are respectively 5.6 kΩ, 6.8 kΩ, and 2.7 kΩ, the load elements 11 to 13 of the discharge devices A1 to A3 are respectively 3.6 kΩ, 2.2 kΩ, and 5.6 kΩ, and voltage (an example of a prescribed value) at the points denoted by X1 to X3 is the same 2.0 V, but the prescribed value is not limited thereto. Moreover, in the first embodiment, the load elements 11 to 13 of the discharge devices A1 to A3 not only determine voltage (an example of a prescribed value) at the points denoted by X1 to X3 but are also factors that determine the period of time required to discharge. By decreasing the resistance of the load elements 11 to 13 of the discharge devices A1 to A3, the period of time required to discharge can be reduced. On the other hand, by increasing the resistance of the load elements 11 to 13 of the discharge devices A1 to A3, power consumption can be reduced.

With the display device according to the first embodiment described above, due to the discharge limiting devices B1 to B3, voltage (voltage due to a parasitic capacitance) of inactive common lines can be made uniform or approximately uniform even when there is variation in voltage drop of the rectifying devices D1 to D3. Therefore, a high quality display device with superior uniformity with respect to a degree of erroneous lighting of the respective light emitting elements 1 to 6 and magnitude of a reverse voltage that applies to the respective light emitting elements 1 to 6 can be provided.

[Display Device According to Second Embodiment]

Figure 2A:
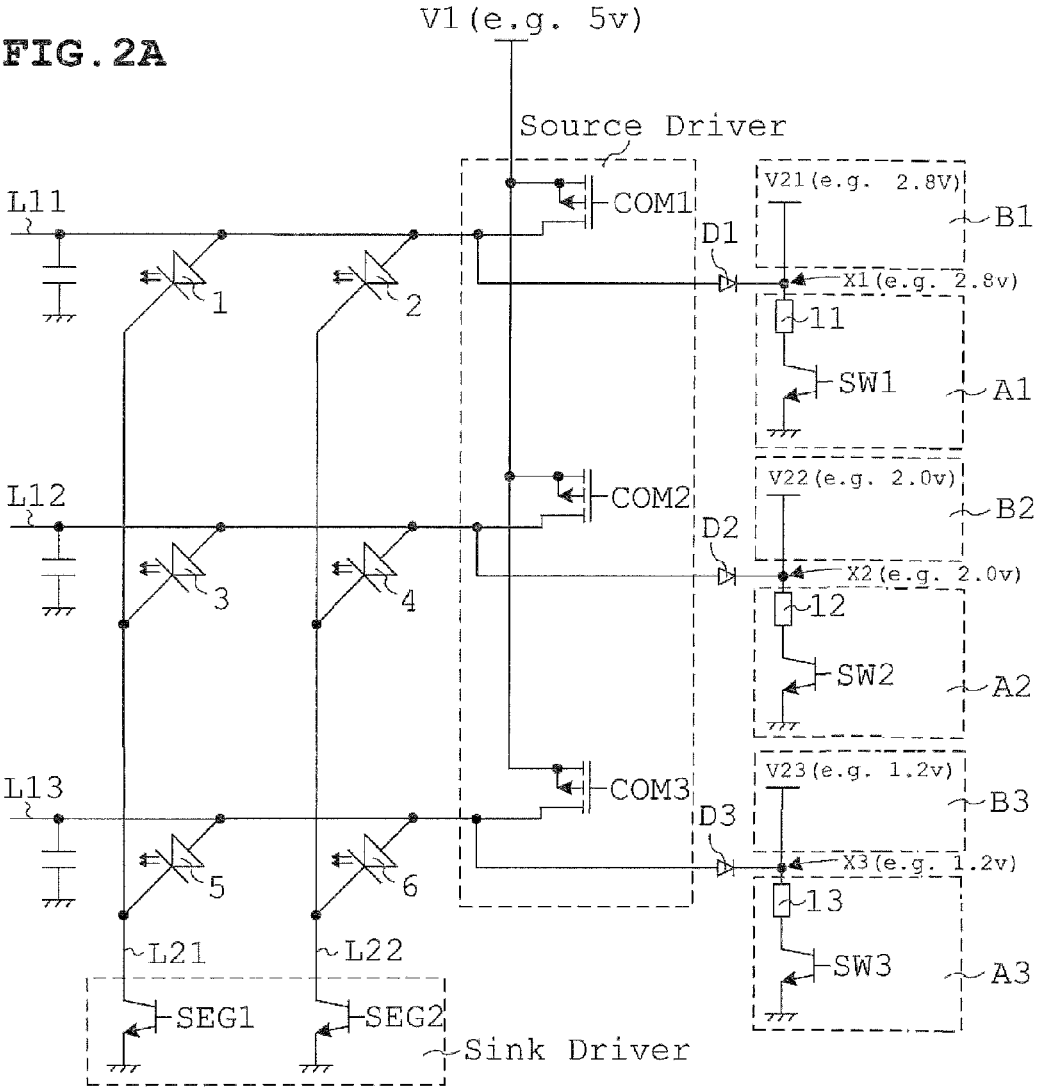
FIGS. 2A and 2B shows a circuit diagram (FIG. 2A) and a timing chart (FIG. 2B) of a display device according to a second embodiment.
Figure 2B:
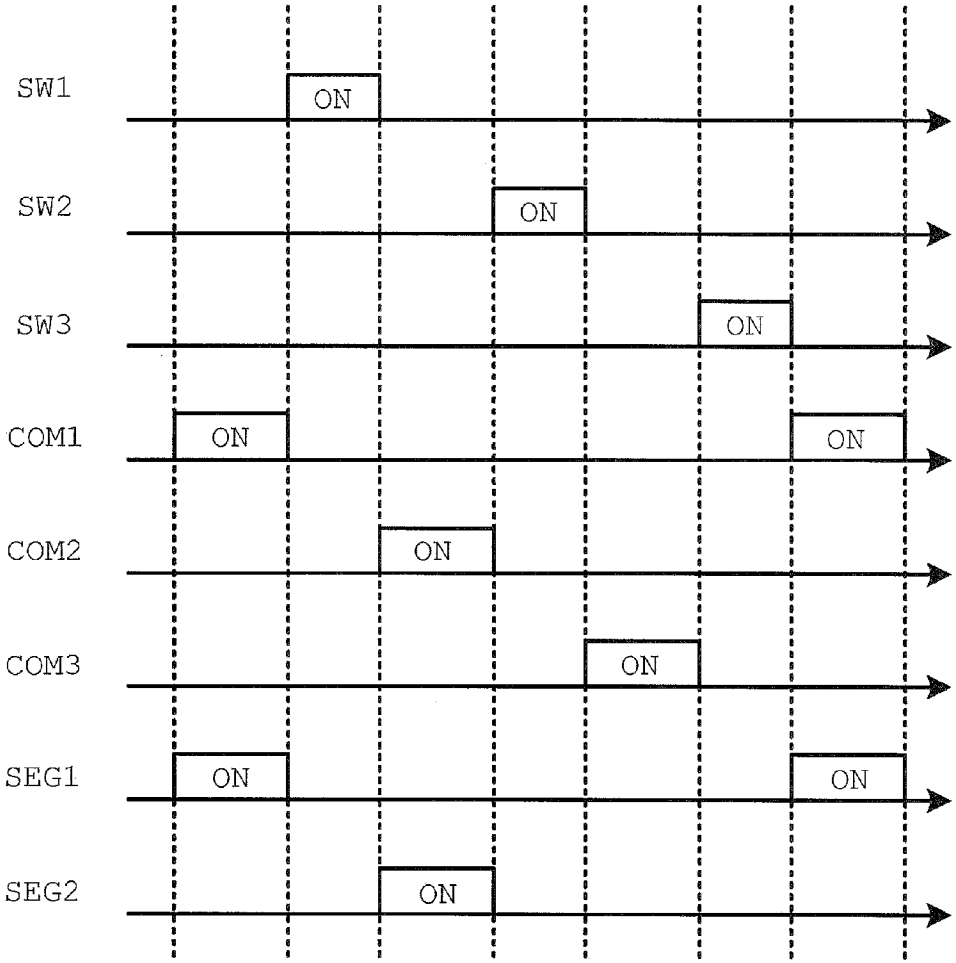

FIG. 2 shows a circuit diagram (FIG. 2A) and a timing chart (FIG. 2B) of a display device according to a second embodiment.

As shown in FIG. 2A, the display device according to the second embodiment differs from the display device according to the first embodiment in that the discharge devices A1 to A3 include semiconductor switches SW1 to SW3 (example: N channel FETs or NPN transistors) and that the discharge limiting devices B1 to B3 do not include the load elements 21 to 23. One end of the semiconductor switches SW1 to SW3 is connected to a side of the common lines L11 to L13 and another end thereof is connected to a side of ground.

(Operations)

As shown in FIG. 2B, when scanning by the source driver starts, voltage is applied to the plurality of common lines L11 to L13 by time division. Specifically, the semiconductor switches COM1 to COM3 repetitively open and close by a prescribe time interval in a sequence of the semiconductor switch COM1, the semiconductor switch COM2, the semiconductor switch COM3, the semiconductor switch COM1, and so on and voltage is sequentially applied to the plurality of common lines L11 to L13.

The sink driver draws a current from one or more driving lines among the plurality of driving lines L21 and L22 to turn on one or more light emitting elements which is or are connected to the one or more driving lines. In this case, assuming that the light emitting elements 1 and 4 are light emitting elements to be turned on, the semiconductor switch SEG1 closes and a current is drawn from the driving line L21 when voltage is being applied to the common line L11, and the semiconductor switch SEG2 closes and a current is drawn from the driving line L22 when voltage is being applied to the common line L12. Accordingly, the light emitting elements 1 and 4 are lighted.

The semiconductor switch SW1 included in the discharge device A1 closes at a certain timing during a period between the end of application of voltage to the common line L11 by the source driver and the start of application of voltage to the common line L12 by the source driver or, in other words, at a certain timing during a period from closing of the semiconductor switch COM1 to opening of the semiconductor switch COM2. Accordingly, when the common line L11 is inactive (when voltage is not being applied by the source driver), a parasitic capacitance thereof is discharged via the rectifying device D1 and the discharge device A1.

In a similar manner, the semiconductor switch SW2 included in the discharge device A2 closes at a certain timing during a period between the end of application of voltage to the common line L12 by the source driver and the start of application of voltage to the common line L13 by the source driver or, in other words, at a certain timing during a period from closing of the semiconductor switch COM2 to opening of the semiconductor switch COM3. Accordingly, when the common line L12 is inactive (when voltage is not being applied by the source driver), a parasitic capacitance thereof is discharged via the rectifying device D2 and the discharge device A2.

In a similar manner, the semiconductor switch SW3 included in the discharge device A3 closes at a certain timing during a period between the end of application of voltage to the common line L13 by the source driver and the start of application of voltage to the common line L11 by the source driver or, in other words, at a certain timing during a period from closing of the semiconductor switch COM3 to opening of the semiconductor switch COM1. Accordingly, when the common line L13 is inactive (when voltage is not being applied by the source driver), a parasitic capacitance thereof is discharged via the rectifying device D3 and the discharge device A3.

These discharges are limited by the discharge limiting devices B1 to B3 so that voltage at the respective common lines L11 to L13 is not lowered below a prescribed value. More specifically, in the second embodiment, voltage at points denoted by X1 to X3 in FIG. 2A is set as a prescribed value, and a parasitic capacitance of the respective common lines L11 to L13 is discharged by the discharge limiting devices B1 to B3 via the rectifying devices D1 to D3 and the discharge devices A1 to A3 only when the voltage at the respective common lines L11 to L13 respectively exceeds the voltage at the points denoted by X1 to X3.

The voltage at the points denoted by X1 to X3 is determined by voltage supplied by the voltage supplying units V21 to V23 of the discharge limiting devices B1 to B3, and is independent of a voltage drop of the rectifying devices D1 to D3. Therefore, the display device according to the second embodiment is capable of making voltage (voltage due to a parasitic capacitance) of inactive common lines uniform or approximately uniform even when there is variation in voltage drop of the rectifying devices D1 to D3. Moreover, in the second embodiment, a case has been described in which voltage supplied by the voltage supplying units V21 to V23 is respectively 2.8 V, 2.0 V, and 1.2 V and voltage (an example of a prescribed value) at the points denoted by X1 to X3 is 2.8 V, 2.0 V, and 1.2 V, but the prescribed value is not limited thereto. Moreover, in the second embodiment, the load elements 11 to 13 of the discharge devices A1 to A3 are not factors that determine voltage (an example of a prescribed value) at the points denoted by X1 to X3 but are factors that determine the period of time required to discharge. In the second embodiment, since reduction in power consumption is achieved by the semiconductor switches SW1 to SW3, values of the load elements 11 to 13 of the discharge devices A1 to A3 are small (example: 200Ω) and the period of time required to discharge is short.

With the display device according to the second embodiment described above, due to the discharge limiting devices B1 to B3, voltage (voltage due to a parasitic capacitance) of inactive common lines can be made uniform or approximately uniform even when there is variation in voltage drop of the rectifying devices D1 to D3 in a similar manner to the display device according to the first embodiment. Therefore, a high quality display device with superior uniformity with respect to frequency of erroneous lighting of the respective light emitting elements 1 to 6 and magnitude of a reverse voltage that applies to the respective light emitting elements 1 to 6 can be provided.

In addition, with the display device according to the second embodiment, by opening the semiconductor switches SW1 to SW3 and releasing electric conduction between the discharge limiting devices B1 to B3 and ground after voltage at the common lines L11 to L13 is lowered to a prescribed value, an unnecessary current is prevented from flowing from the discharge limiting devices B1 to B3 to the discharge devices A1 to A3, and reduction in power consumption can be achieved.

[Display Device According to Third Embodiment]

Figure 3A:
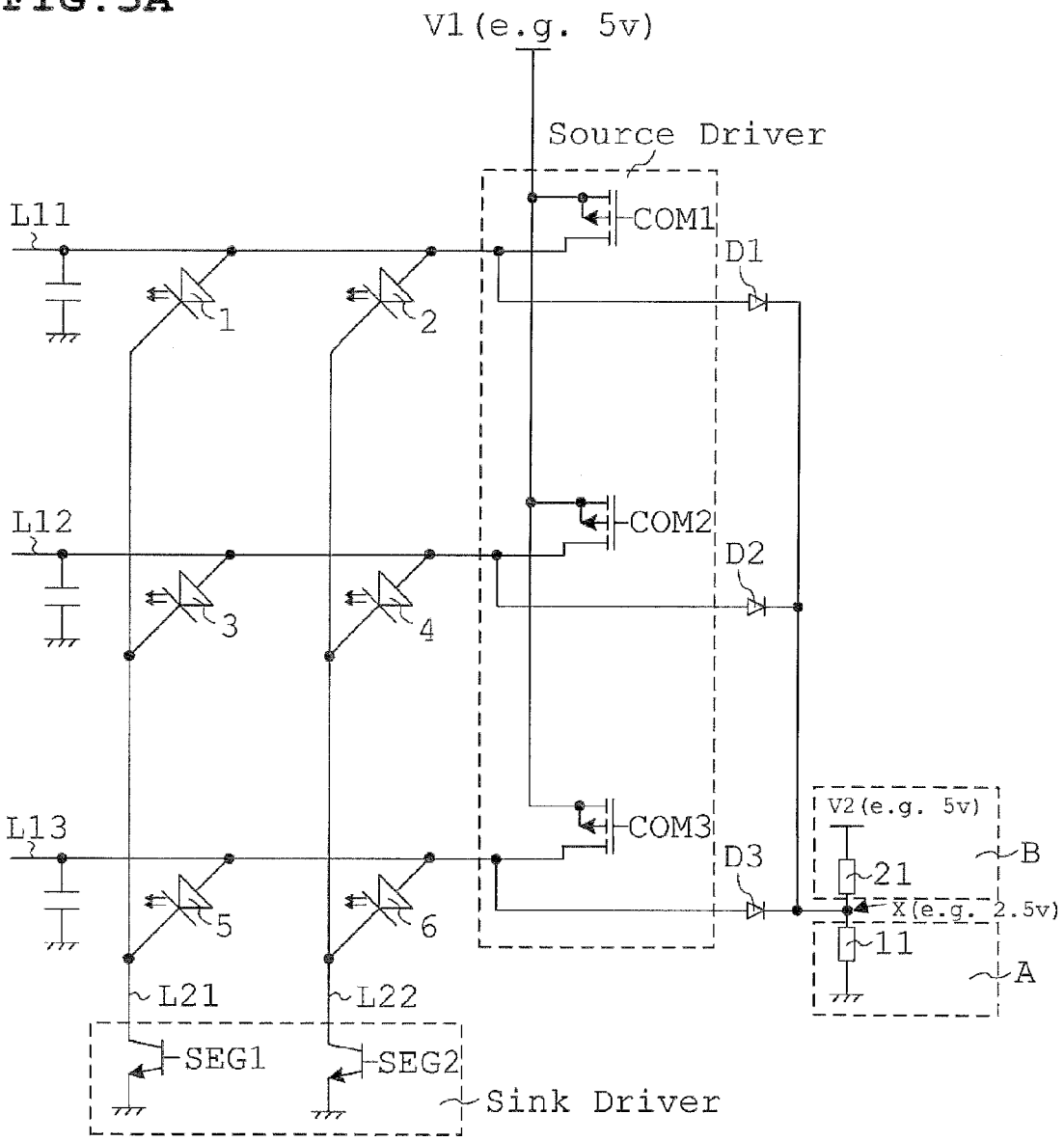
FIGS. 3A and 3B shows a circuit diagram (FIG. 3A) and a timing chart (FIG. 3B) of a display device according to a third embodiment.
Figure 3B:
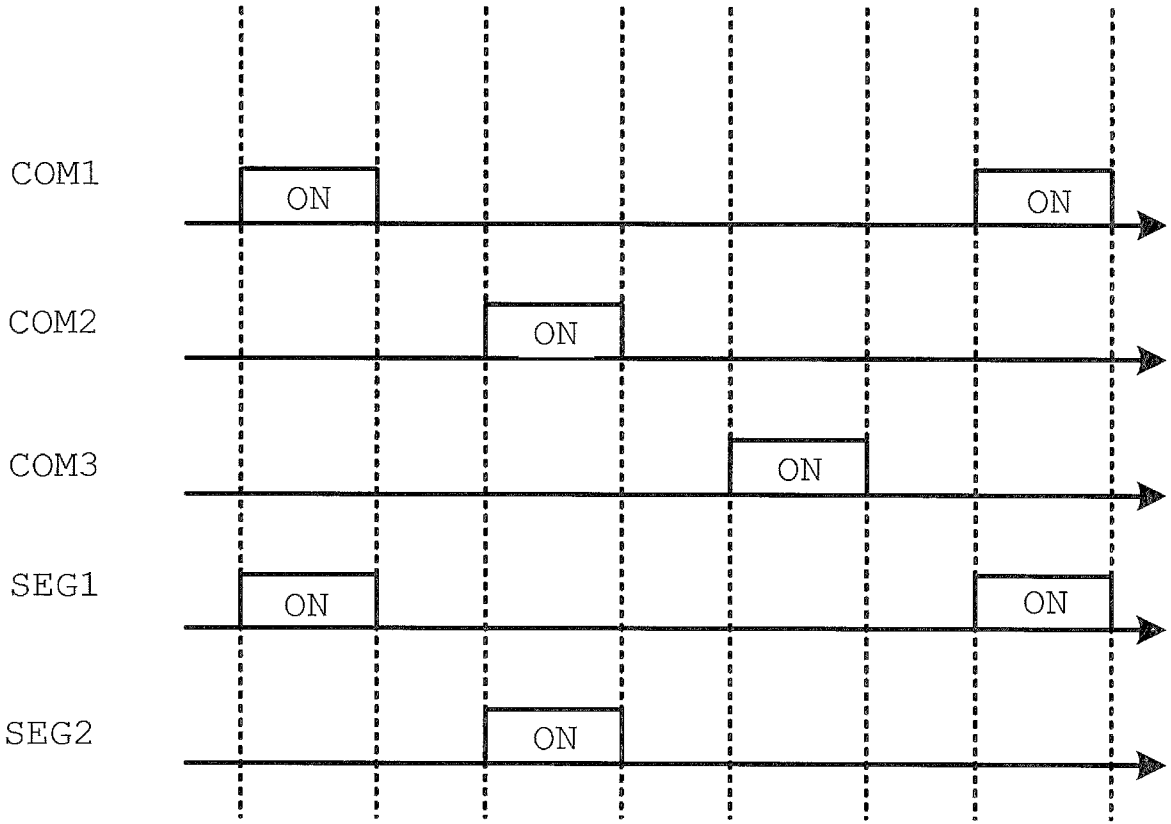

FIG. 3 shows a circuit diagram (FIG. 3A) and a timing chart (FIG. 3B) of a display device according to a third embodiment.

As shown in FIG. 3A, the display device according to the third embodiment differs from the display device according to the first embodiment in that two or more common lines L11 to L13 are connected to one discharge device A and one discharge limiting device B. The two or more common lines are among the plurality of common lines.

(Operations)

As shown in FIG. 3B, when scanning by the source driver starts, voltage is applied to the plurality of common lines L11 to L13 by time division. Specifically, the semiconductor switches COM1 to COM3 repetitively open and close by a prescribe time interval in a sequence of the semiconductor switch COM1, the semiconductor switch COM2, the semiconductor switch COM3, the semiconductor switch COM1, and so on and voltage is sequentially applied to the plurality of common lines L11 to L13.

The sink driver draws a current from one or more driving lines among the plurality of driving lines L21 and L22 to turn on one or more light emitting elements which is or are connected to the one or more driving lines. In this case, assuming that the light emitting elements 1 and 4 are light emitting elements to be turned on, the semiconductor switch SEG1 closes and a current is drawn from the driving line L21 when voltage is being applied to the common line L11, and the semiconductor switch SEG2 closes and a current is drawn from the driving line L22 when voltage is being applied to the common line L12. Accordingly, the light emitting elements 1 and 4 are lighted.

When the common lines L11 to L13 are inactive (when voltage is not being applied by the source driver), parasitic capacitances thereof are respectively discharged via the rectifying devices D1 to D3 and the discharge device A. However, the discharges are limited by the discharge limiting device B so that voltage at the respective common lines L11 to L13 is not lowered below a prescribed value. More specifically, in the third embodiment, voltage at a point denoted by X in FIG. 3A is set as a prescribed value, and a parasitic capacitance of the respective common lines L11 to L13 is discharged by the discharge limiting device B via the rectifying devices D1 to D3 and the discharge device A only when the voltage at the respective common lines L11 to L13 respectively exceeds the voltage at the point denoted by X.

The voltage at the point denoted by X is determined by a relationship between voltage supplied by the voltage supplying unit V2 of the discharge limiting device B and the load element 21 of the discharge limiting device B and the load element 11 of the discharge device A, and is independent of a voltage drop of the rectifying devices D1 to D3. Therefore, the display device according to the third embodiment is capable of making voltage (voltage due to a parasitic capacitance) of inactive common lines uniform or approximately uniform even when there is variation in voltage drop of the rectifying devices D1 to D3. Moreover, in the third embodiment, a case has been described in which voltage supplied by the voltage supplying unit V2 is 5 V, the load element 21 of the discharge limiting device B is 470Ω, the load element 11 of the discharge device A is 470Ω, and voltage (an example of a prescribed value) at the point denoted by X is 2.5 V, but the prescribed value is not limited thereto. In the third embodiment, the load element 11 of the discharge device A not only determines voltage (an example of a prescribed value) at the point denoted by X but is also a factor that determines the period of time required to discharge. By decreasing the resistance of the load element 11 of the discharge device A, the period of time required to discharge can be reduced. On the other hand, by increasing the resistance of the load element 11 of the discharge device A, power consumption can be reduced.

With the display device according to the third embodiment described above, although two or more common lines L11 to L13 are connected to one discharge device A and one discharge limiting device B, due to the discharge limiting device B, voltage (voltage due to a parasitic capacitance) of inactive common lines can be made uniform or approximately uniform even when there is variation in voltage drop of the rectifying devices D1 to D3 in a similar manner to the display device according to the first embodiment. Therefore, a high quality display device with superior uniformity with respect to frequency of erroneous lighting of the respective light emitting elements 1 to 6 and magnitude of a reverse voltage that applies to the respective light emitting elements 1 to 6 can be provided.

[Display Device According to Fourth Embodiment]

Figure 4A:
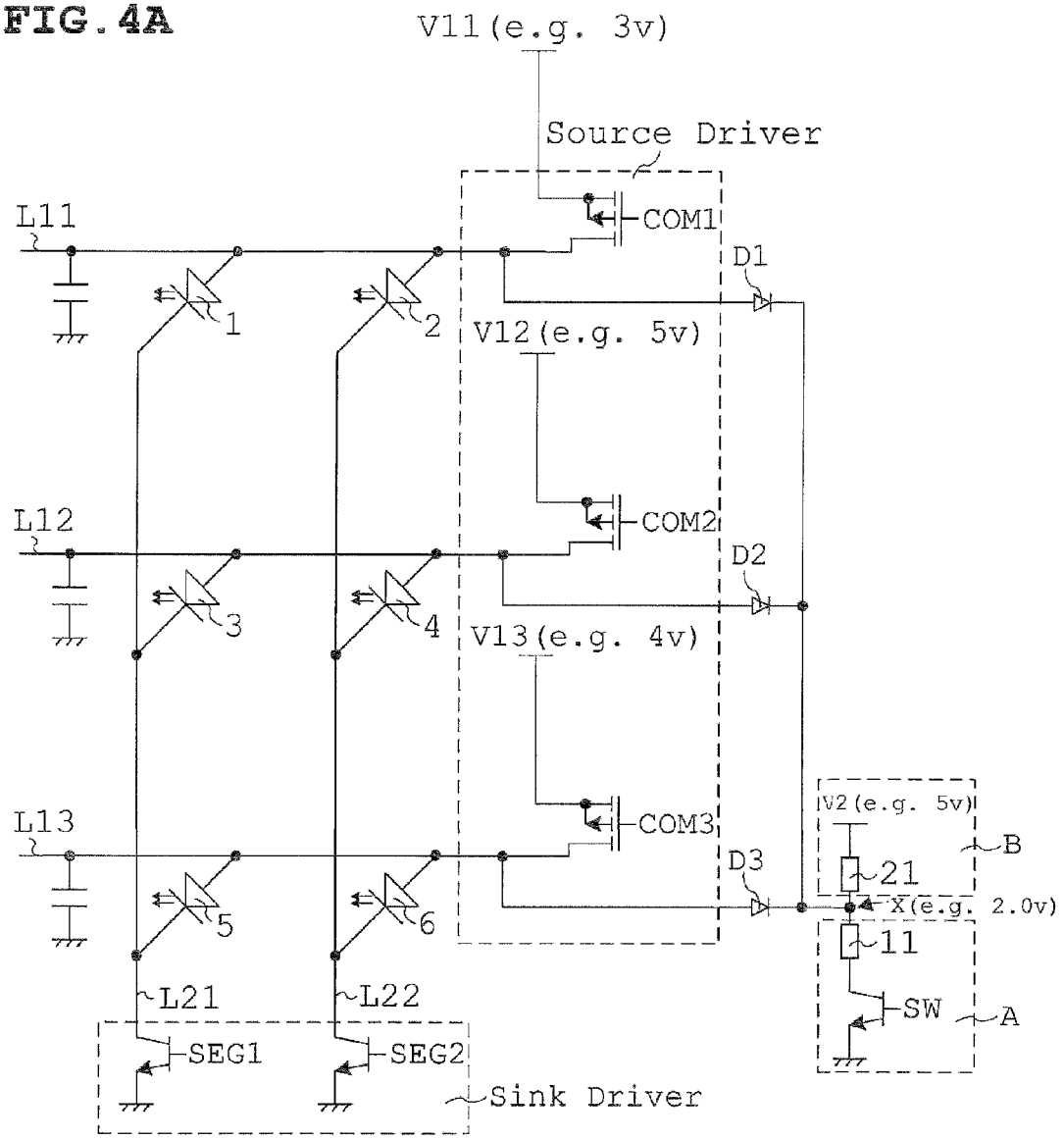
FIGS. 4A and 4B is a circuit diagram (FIG. 4A) and a timing chart (FIG. 4B) of a display device according to a fourth embodiment.
Figure 4B:
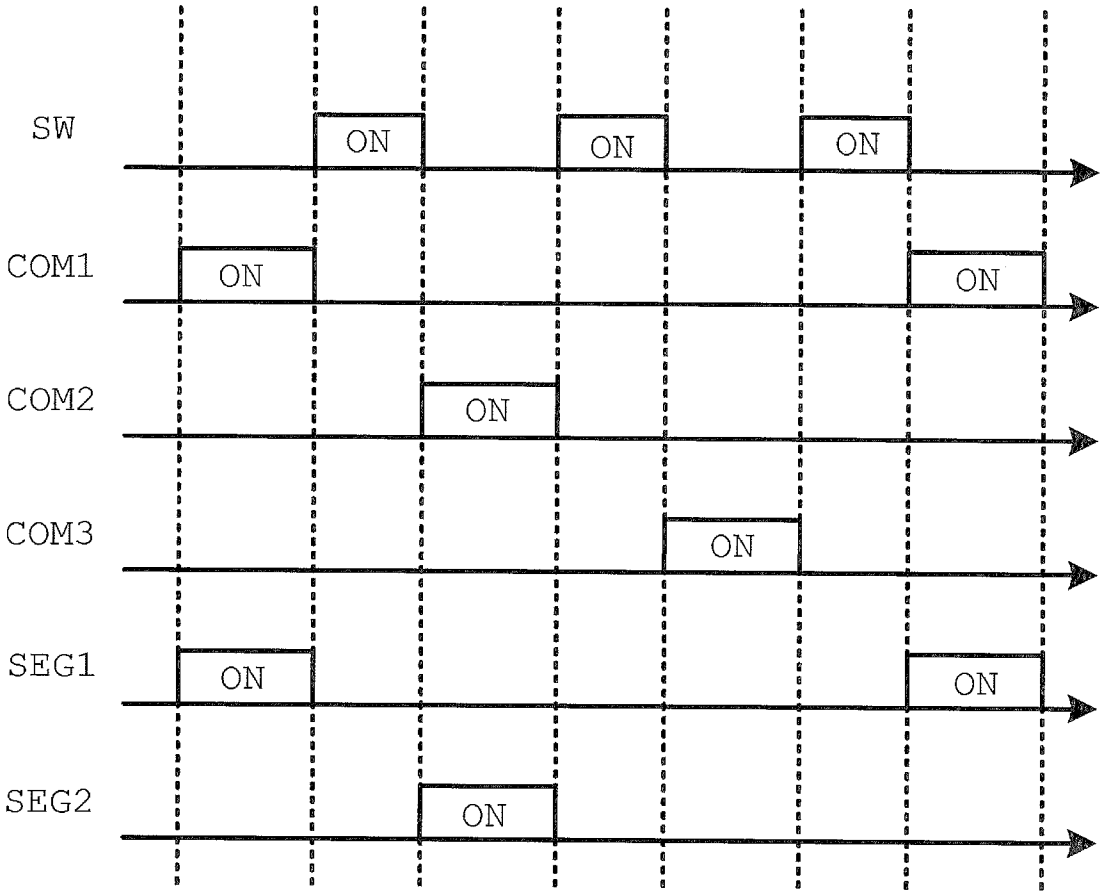

FIG. 4 shows a circuit diagram (FIG. 4A) and a timing chart (FIG. 4B) of a display device according to a fourth embodiment.

As shown in FIG. 4A, the display device according to the fourth embodiment differs from the display device according to the third embodiment in that the discharge device A includes a semiconductor switch SW (example: an N channel FET or an NPN transistor). One end of the semiconductor switch SW is connected to a side of the common lines L11 to L13 and another end thereof is connected to a side of ground.

(Operations)

As shown in FIG. 4B, when scanning by the source driver starts, voltage is applied to the plurality of common lines L11 to L13 by time division. Specifically, the semiconductor switches COM1 to COM3 repetitively open and close by a prescribe time interval in a sequence of the semiconductor switch COM1, the semiconductor switch COM2, the semiconductor switch COM3, the semiconductor switch COM1, and so on and voltage is sequentially applied to the plurality of common lines L11 to L13.

The sink driver draws a current from one or more driving lines among the plurality of driving lines L21 and L22 to turn on one or more light emitting elements which is or are connected to the one or more driving lines. In this case, assuming that the light emitting elements 1 and 4 are light emitting elements to be turned on, the semiconductor switch SEG1 closes and a current is drawn from the driving line L21 when voltage is being applied to the common line L11, and the semiconductor switch SEG2 closes and a current is drawn from the driving line L22 when voltage is being applied to the common line L12. Accordingly, the light emitting elements 1 and 4 are lighted.

The semiconductor switch SW included in the discharge device A closes at a certain timing during a period between the end of application of voltage to any of the common lines L11 to L13 by the source driver and the start of application of voltage to any of the common lines L11 to L13 by the source driver or, in other words, at a certain timing during a period from closing of any of the semiconductor switches COM1 to COM3 to opening of any of the semiconductor switches COM1 to COM3. Accordingly, when the common lines L11 to L13 are inactive (when voltage is not being applied by the source driver), parasitic capacitances thereof are respectively discharged via the rectifying devices D1 to D3 and the discharge device A.

The discharges are limited by the discharge limiting device B so that voltage at the respective common lines L11 to L13 is not lowered below a prescribed value. More specifically, in the fourth embodiment, voltage at points denoted by X1 to X3 in FIG. 4A is set as a prescribed value, and a parasitic capacitance of the respective common lines L11 to L13 is discharged by the discharge limiting device B via the rectifying devices D1 to D3 and the discharge device A only when the voltage at the respective common lines L11 to L13 respectively exceeds the voltage at the points denoted by X1 to X3.

The voltage at the points denoted by X1 to X3 is determined by a relationship between voltage supplied by the voltage supplying unit V2 of the discharge limiting device B and the load element 21 of the discharge limiting device B and the load element 11 of the discharge device A, and is independent of a voltage drop of the rectifying devices D1 to D3. Therefore, the display device according to the fourth embodiment is capable of making voltage (voltage due to a parasitic capacitance) of inactive common lines uniform or approximately uniform even when there is variation in voltage drop of the rectifying devices D1 to D3. Moreover, in the fourth embodiment, a case has been described in which voltage supplied by the voltage supplying unit V2 is 5 V, the load element 21 of the discharge limiting device B is 560Ω, the load element 11 of the discharge device A is 360Ω, and voltage (an example of a prescribed value) at the point denoted by X is 2.0 V, but the prescribed value is not limited thereto. In the fourth embodiment, the load element 11 of the discharge device A not only determines voltage (an example of a prescribed value) at the point denoted by X but is also a factor that determines the period of time required to discharge. By decreasing the resistance of the load element 11 of the discharge device A, the period of time required to discharge can be reduced. On the other hand, by increasing the resistance of the load element 11 of the discharge device A, power consumption can be reduced. Moreover, in the fourth embodiment, reduction in power consumption is also achieved by the semiconductor switches SW1 to SW3.

With the display device according to the fourth embodiment described above, due to the discharge limiting device B, voltage (voltage due to a parasitic capacitance) of inactive common lines can be made uniform or approximately uniform even when there is variation in voltage drop of the rectifying devices D1 to D3 in a similar manner to the display device according to the third embodiment. Therefore, a high quality display device with superior uniformity with respect to frequency of erroneous lighting of the respective light emitting elements 1 to 6 and a reverse voltage that applies to the respective light emitting elements 1 to 6 can be provided.

In addition, with to the display device according to the fourth embodiment, by opening the semiconductor switch SW and releasing electric conduction between the discharge limiting device B and ground after voltage at the common lines L11 to L13 is lowered to a prescribed value, an unnecessary current is prevented from flowing from the discharge limiting device B to the discharge device A and reduction in power consumption can be achieved.

[Open Fault, Short Circuit Fault]

Display devices according to the first to fourth embodiments have been described above. The prescribed value with respect to the display devices according to the first to fourth embodiments is determined independent of a voltage drop of the rectifying devices. Therefore, even when an open fault or a short circuit fault occurs at one rectifying device, the prescribed value does not change. Consequently, even when an open fault or a short circuit fault occurs at one rectifying device, voltage at other light emitting elements connected to a common line to which a rectifying device in which an open fault or a short circuit fault does not occur is connected can be continuously made uniform or approximately uniform when inactive (when voltage is not being applied by the source driver). As a result, according to the first to fourth embodiments, display devices that are resistant to an open fault or a short circuit fault can be provided.

[Other]

Moreover, as shown in FIG. 4A, voltage applied by the source driver differs among the respective common lines L11 to L13 in the display device according to the fourth embodiment and, specifically, voltage is set to V11=3 V for the common line L11, V12=5 V for the common line L12, and V13=4 V for the common line L13. However, even in such a case, since the prescribed value is determined independent of a voltage drop of rectifying devices, voltage (voltage due to a parasitic capacitance) of an inactive common line can be made uniform or approximately uniform.

First Example

Next, a display device according to a first example will be described.

In the display device according to the first example, 24 common lines and 48 driving lines were arranged so as to intersect each other, and 1152 light emitting diodes (including light emitting diode chips of three types of red, green, and blue) were respectively arranged at the respective intersections of the common lines and the driving lines.

A P channel MOSFET was used as a source driver and an NPN bipolar transistor driven by a constant current set to around 15 mA was used as a sink driver. In addition, the third embodiment (refer to FIG. 3) was adopted as a connection relationship among a discharge limiting device, a discharge device, rectifying devices, and common lines.

Voltage supplied by a voltage supplying unit V1 was set to 5 V. In addition, voltage supplied by a voltage supplying unit V2 was set to 5 V, a 3.9 kΩ resistor was used as a load element 21 of the discharge limiting device B, and a 5.1 kΩ resistor was used as a load element 11 of the discharge device A. A prescribed value is determined by the voltage supplied by the voltage supplying unit V2, the load element 21 of the discharge limiting device B, and the load element 11 of the discharge device A and is 2.8 V (voltage at point corresponding to X in FIG. 3). Switching diodes were used as the rectifying devices D1, D2, . . . , D24.

The display device according to the first example described above was dynamically driven at a duty ratio of 1/24, a frequency by which common lines are scanned set to 86.8 μs, a period during which the source driver applies voltage to a scanned common line set to 76.8 μs, and a period during which voltage is not applied set to 10 μs.

In addition, in order to clarify whether erroneous lighting has occurred and whether reverse voltage is applied, diagonal lighting was intentionally performed or, in other words, light emitting diodes arranged in a diagonal direction among 1152 light emitting diodes arranged in a matrix pattern were lighted.

With respect to the display device according to the first example described above, visual confirmation of erroneous lighting and confirmation of reverse voltage using an oscilloscope revealed that no erroneous lighting had occurred among the light emitting diodes and that the reverse voltage applied to light emitting diodes not lighted was kept low.

Therefore, the display device according to the first example can be evaluated as a high quality display device.

First Comparative Example

Next, a display device according to a first comparative example will be examined.

As the display device according to the first comparative example, a display device was used which basically shares the same configuration as the display device according to the first example but which does not include a discharge limiting device, a discharge device, and a rectifying device.

As a result of performing diagonal lighting or, in other words, lighting light emitting diodes arranged in a diagonal direction among 1152 light emitting diodes arranged in a matrix pattern with the display device according to the first comparative example, erroneous lighting was confirmed at several light emitting diodes which are connected to a same driving line as lighted light emitting diodes and which are connected to common lines separated by a range of several lines from common lines to which the lighted light emitting diodes are connected.

Therefore, the display device according to the first comparative example can be evaluated as a display device of inferior quality.

Second Comparative Example

Next, a display device according to a second comparative example will be examined.

As the display device according to the second comparative example, a display device was used which basically shares the same configuration as the display device according to the first example but which does not include a discharge limiting device.

As a result of performing diagonal lighting or, in other words, lighting light emitting diodes arranged in a diagonal direction among 1152 light emitting diodes arranged in a matrix pattern with the display device according to the second comparative example, erroneous lighting was not confirmed, but it was found that a large reverse voltage was applied to light emitting diodes that were not lighted.

As shown, the display device according to the second comparative example can be evaluated as a display device in which a large reverse voltage applies to light emitting diodes because a discharge limiting device is not provided.

Embodiments and examples have been described above, but the description merely represents examples and is not intended to limit in any way whatsoever.

Obviously, numerous modifications and variations of the present invention are possible in light of the above teachings. It is therefore to be understood that within the scope of the appended claims, the invention may be practiced otherwise than as specifically described herein.

What is claimed is:

1. A display device comprising:

a plurality of common lines;

a plurality of driving lines;

a plurality of light emitting elements connected to the plurality of common lines and the plurality of driving lines;

a source driver configured to apply voltage by time division to the plurality of common lines;

a sink driver configured to draw a current from one or more driving lines among the plurality of driving lines to turn on one or more light emitting elements;

at least one discharge device connected to the common lines, the at least one discharge device being configured to lower voltage at a respective common line when voltage is not applied to the respective common line by the source driver;

at least one discharge limiting device connected to the common lines and to the at least one discharge device, the at least one discharge limiting device being configured to apply a limitation so that the voltage at the respective common line is not lowered below a prescribed value by the at least one discharge device when voltage is not applied to the respective common line by the source driver; and rectifying devices connected between the at least one discharge device and the at least one discharge limiting device, and the common lines, and which pass a current from the common lines toward the at least one discharge device and the at least one discharge limiting device but do not pass a current from the at least one discharge device and the at least one discharge limiting device toward the common lines.

2. The display device according to claim 1, wherein the at least one discharge device is a plurality of discharge devices, and wherein the at least one discharge limiting device is a plurality of discharge limiting devices.

3. The display device according to claim 2, wherein parasitic capacitances of the plurality of common lines are respectively discharged via the rectifying devices and the discharge devices when voltage is not being applied by the source driver.

4. The display device according to claim 2, wherein voltage at points where the discharge devices, the discharge limiting devices, and the rectifying devices are connected is set as a prescribed value, and parasitic capacitances of the plurality of common lines are respectively discharged via the rectifying devices and the discharge devices only when the voltage at each of the plurality of common lines is greater than the voltage set as the prescribed value.

5. The display device according to claim 2, wherein the discharge devices include load elements.

6. The display device according to claim 2, wherein the discharge limiting devices include load elements.

7. The display device according to claim 2, wherein both the discharge devices and the discharge limiting devices include load elements.

8. The display device according to claim 2, wherein the discharge devices include semiconductor switches each having one end connected to a side of the common line and another end connected to a side of ground.

9. The display device according to claim 8, wherein each of the semiconductor switches is closed at a certain timing during a period between an end of application of voltage by the source driver to a common line among the plurality of common lines which is connected to a discharge device among the discharge devices that includes the semiconductor switch and a start of application of voltage by the source driver to another common line among the plurality of common lines.

10. The display device according to claim 8, wherein each of the semiconductor switches is opened after the voltage at the common line is lowered to a prescribed value, and electric connection between the discharge limiting devices and the ground is released.

11. The display device according to claim 2, wherein the discharge devices include semiconductor switches each having one end connected to the common line and another end connected to ground, and only the discharge devices among the discharge devices and the discharge limiting devices include load elements.

12. The display device according to claim 2, wherein the discharge devices include semiconductor switches each having one end connected to a side of the common line and another end connected to a side of ground, and both the discharge devices and the discharge limiting devices include load elements.

13. The display device according to claim 2, wherein the discharge devices are respectively connected to the plurality of common lines.

14. The display device according to claim 2, wherein the discharge limiting devices are respectively connected to the plurality of common lines.

15. The display device according to claim 2, wherein two or more common lines are connected to one discharge device among the discharge devices and one discharge limiting device among the discharge limiting devices, the two or more common lines are among the plurality of common lines.

16. The display device according to claim 1, wherein voltage applied to the plurality of common lines by the source driver differs among the common lines.

* * * * *